US007500668B2

(12) United States Patent
DeJong et al.

(10) Patent No.: US 7,500,668 B2
(45) Date of Patent: Mar. 10, 2009

(54) DUPLEX REGISTRATION SYSTEMS AND METHODS

(75) Inventors: Joannes N. M. DeJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 385 days.

(21) Appl. No.: 11/251,644

(22) Filed: Oct. 14, 2005

(65) Prior Publication Data

US 2007/0085265 A1 Apr. 19, 2007

(51) Int. Cl.
*B65H 7/02* (2006.01)

(52) U.S. Cl. ..... 271/227

(58) Field of Classification Search ..... 271/227
See application file for complete search history.

(56) References Cited

U.S. PATENT DOCUMENTS

| | | | | |
|---|---|---|---|---|
| 4,685,664 | A * | 8/1987 | Petersdorf | 271/227 |
| 4,971,304 | A | 11/1990 | Lofthus | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,725,211 | A * | 3/1998 | Blanchard et al. | 271/265.02 |
| 5,794,176 | A | 8/1998 | Milillo | |
| 5,930,577 | A * | 7/1999 | Forsthoefel et al. | 399/401 |
| 5,984,301 | A * | 11/1999 | Holbert et al. | 271/227 |
| 6,032,004 | A | 2/2000 | Mirabella, Jr. et al. | |
| 6,137,989 | A | 10/2000 | Quesnel | |
| 6,168,153 | B1 | 1/2001 | Richards et al. | |
| 6,173,952 | B1 * | 1/2001 | Richards et al. | 271/228 |
| 6,322,265 | B1 * | 11/2001 | Mindek et al. | 400/648 |
| 6,340,984 | B1 * | 1/2002 | Ui et al. | 347/139 |
| 6,533,268 | B2 | 3/2003 | Williams et al. | |
| 6,813,451 | B2 * | 11/2004 | Wibbels | 399/45 |
| 6,817,609 | B2 * | 11/2004 | Halvonik et al. | 271/228 |
| 6,895,210 | B1 * | 5/2005 | Quesnel | 399/395 |
| 6,920,307 | B2 * | 7/2005 | Howe | 399/395 |
| 6,988,725 | B2 * | 1/2006 | Rapkin | 271/227 |
| 7,219,888 | B2 * | 5/2007 | Trovinger et al. | 271/227 |
| 7,222,848 | B2 * | 5/2007 | Elliott et al. | 271/226 |
| 2003/0146567 | A1 | 8/2003 | Williams et al. | |
| 2004/0036847 | A1 | 2/2004 | Conrow et al. | |
| 2004/0094891 | A1 * | 5/2004 | Trovinger et al. | 271/227 |

* cited by examiner

*Primary Examiner*—Patrick H Mackey
*Assistant Examiner*—Howard Sanders
(74) *Attorney, Agent, or Firm*—Gibb I.P. Law Firm, LLC

(57) ABSTRACT

An electrostatographic and/or xerographic machine includes a media path adapted to move a media sheet. Sensors are positioned adjacent the media path. The media sheet has a leading edge and a trailing edge and the sensors are adapted to identify locations of the leading edge and the trailing edge of the media sheet. A marking device is positioned adjacent the media path. The marking device is adapted to print first items on a first side of the media sheet and print second items on a second side of the media sheet. A registration controller is operatively connected to the media path and to the sensors. The registration controller determines a length between the leading edge and the trailing edge of the media sheet using output from the sensors, and determines the parallelism between the leading edge and the trailing edge of the media sheet using output from the sensors. The registration controller calculates a registration correction factor based upon the length and the parallelism and corrects the alignment of the first items printed on the first side of the media sheet with the second items printed on the second side of the media sheet using the registration correction factor.

18 Claims, 3 Drawing Sheets

PAPER REGISTRATION OF NON-RECTANGULAR SHEETS

DUPLEX REGISTRATION SYSTEMS AND METHODS

BACKGROUND

The embodiments herein generally relate to media registration in duplex printers. As explained in U.S. Patent Publication 2004/0036847, the complete disclosure of which is incorporated herein by reference, duplex printing can be conducted with a system that forms images on both sides of a sheet at a single transfer station. In some duplex printing systems, after a sheet has received a first image on a first side by passing the sheet through an image transfer station, the sheet is inverted. A second image is then formed on a second side of the sheet by passing the inverted sheet through the same transfer station.

Positioning an image on one side of a sheet in a manner that coincides with the position of the image on the other side of the sheet can be difficult. Registration of a first image on a first side of a sheet with a second image on a second side of a sheet is not always accurate because of one or more registration errors that offset the first image relative to the second image. For example, a page number printed on the bottom-center position of the first side of a two-sided, printed document should align exactly with the page number printed on the reverse side. The offset of the page number on the second side of a sheet with respect to the page number on the first side of the sheet is a registration error that is extremely undesirable, and considered unacceptable in various printing industries.

Registering two images on the front and back sides of a single sheet of media sheet can be difficult but is essential in industries such as the offset printing industry. In this industry, duplex sheets are sometimes produced having a number of pages, of what will ultimately be a single, multi-page document, aligned on the front and back of a single sheet of media sheet. To create such a multi-page document, a sheet of media sheet is printed with multiple images on the front and back side of a single composite sheet. The single composite sheet is subsequently folded and segmented into individual pages. Each of the images on a first side a sheet must therefore be registered with a corresponding image on a second side of the sheet before the sheet may be segmented into individual pages.

Specifically, the first image that appears on the first side of the sheet and the second image that appears on the second side of the sheet are positioned so that identical images printed on both sides of the sheet are coincident with each other. In other words, two identical images printed on both sides of a sheet of media sheet form mirror images of each other since each image is printed with no apparent offset from the other. Thus, an image on the front side of a sheet would appear to be in perfect or transparent registration with the corresponding image on the back side of the sheet.

The "show through" error that occurs when transparent registration is not achieved can be quantified by measuring of the displacement between two points, one on a first side of the sheet and one on a second side of the sheet, that are intended to be equidistant from a common sheet edge. This error is caused, at least in part, by the factors identified above. The portion of the error associated with media sheet shrinkage is often caused by fusing a printed image on the first side prior to printing of an image on the second side.

Additional background patents that are incorporated herein by reference include U.S. Patent Publication No. 20030146567 published Aug. 7, 2003; U.S. Pat. No. 4,971,304 by Lofthus, issued Nov. 20, 1990; U.S. Pat. No. 5,169,140 by Wenthe, Jr., issued Dec. 8, 1992; U.S. Pat. No. 5,219,159 by Malachowski et al, issued Jun. 15, 1993; U.S. Pat. No. 5,278,624 by Kamprath et al, issued Jan. 11, 1994; U.S. Pat. No. 5,794,176 by Milillo, issued Aug. 11, 1998; U.S. Pat. No. 6,137,989 by Quesnel, issued Oct. 24, 2000; U.S. Pat. No. 6,168,153 B1 by Richards et al, issued Jan. 2, 2001; and U.S. Pat. No. 6,533,268 B2 by Williams et al, issued Mar. 18, 2003.

SUMMARY

An apparatus embodiment herein comprises, for example, an electrostatographic and/or xerographic machine that includes a media path adapted to move a media sheet. Sensors are positioned adjacent the media path. The media sheet has a leading edge and a trailing edge and the sensors are adapted to identify locations of the leading edge and the trailing edge of the media sheet. A marking device is positioned adjacent the media path. The marking device is adapted to print first items on a first side of the media sheet and print second items on a second side of the media sheet.

A registration controller is operatively connected to the media path and to the sensors. The registration controller determines a length between the leading edge and the trailing edge of the media sheet using output from the sensors, and determines the parallelism between the leading edge and the trailing edge of the media sheet using output from the sensors. The registration controller calculates a registration correction factor based upon the length and the parallelism and corrects the alignment of the first items printed on the first side of the media sheet with the second items printed on the second side of the media sheet using the registration correction factor.

Thus, a method embodiment herein positions the media sheet adjacent sensors, determines the length between the leading edge and the trailing edge of the media sheet using output from the sensors, and determines the parallelism between the leading edge and the trailing edge of the media sheet using output from the sensors. Then, the method calculates a registration correction factor based upon the length and the parallelism and corrects an alignment of the first items printed on the first side of the media sheet with the second items printed on the second side of the media sheet using the registration correction factor.

The correction factor indicates divergences from a predetermined length standard and a predetermined parallelism standard. When correcting the alignment, the embodiment adjusts the position of the media sheet with respect to the position of the marking device to compensate for the divergences. The positioning of the media sheet is performed after the first items are printed on the first side of the media sheet. The sensors are adapted to simultaneously identify the locations of the leading edge and the trailing edge. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, two of the major error sources in side 1-side 2 registration are the sheet cut tolerances and media sheet size change that occurs during fusing of the first side printing. The lead edge of the sheet on side 1 becomes the trail edge on side 2 (after inversion). At the input of the registration system, the process and skew (angle) orientation can be established from measurement on the lead edge of side 1. After inversion, what was previously the trail edge, now becomes the lead edge. Hence, any sheet size/geometry tolerances will cause additional side 1-side 2 registration errors.

As discussed in greater detail below, embodiments herein provide a system and method of using multiple sheet edge position sensors. These sensors measure the sheet edge lead edge and trail edge position in a multitude of locations at the same or approximately the same time. Simple calculations yield the values for the sheet length and/or sheet lead edge/trail edge parallelism. The sheet registration controller compensates for these errors by adding appropriated offsets to the registration targets to improve side 1-side 2 registration errors.

Figure 1:
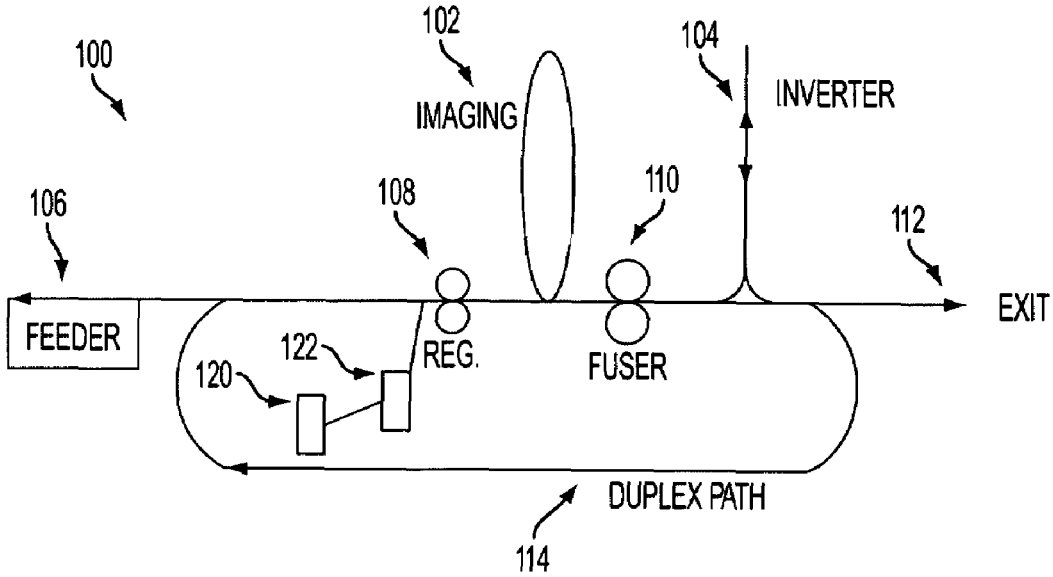
FIG. 1 is a schematic representation of a duplex media sheet path.

As shown in the duplex media sheet path 100 in FIG. 1, media sheets are fed from a feeder 106, and registered with a media sheet registration system 108 before receiving the image from a marking device 102. The image is then fused onto the media by the fuser 110 and the sheet may or may not be inverted by the inverter 104 before it passes through the exit 112. Conventional marking devices, fusers, media sheet paths, etc. are discussed at length in U.S. Pat. No. 6,032,004, the complete disclosure of which is fully incorporated herein by reference. For duplex printing, the sheet must be inverted and routed through the duplex path to present side 2 to the imaging device. Note that inversion may also take place in the duplex path. Inversion transposes the lead edge (LE) and trail edge (TE).

Embodiments herein also include a length/parallelism sensor unit 120 that is shown as being located in the duplex path; however, this location is merely one example and the length/parallelism sensor 120 could be located at any location of the sheet path 100 that allows the sheet to be observed before or after the first side printing is completed (and, therefore, after the media sheet has shrunk from the heating during the fusing of the first side printing), but before registration for the second side printing is performed. The length/parallelism sensor unit 120 is shown in greater detail in FIG. 4, that is discussed below. A registration controller 122 is connected to, among other items, the length/parallelism sensor 120 and the media sheet registration system 108. The registration controller 122 can comprise any conventional logic/memory unit capable of performing comparisons, storing values, storing and executing logical routines, etc. Such controllers are widely available from computer manufactures, such as Intel Corporation, Santa Clara, Calif., USA, etc. Note that, in some embodiments, the length/parallelism sensor unit 120 and the registration controller 120 could be combined into a single unit.

Figure 2:
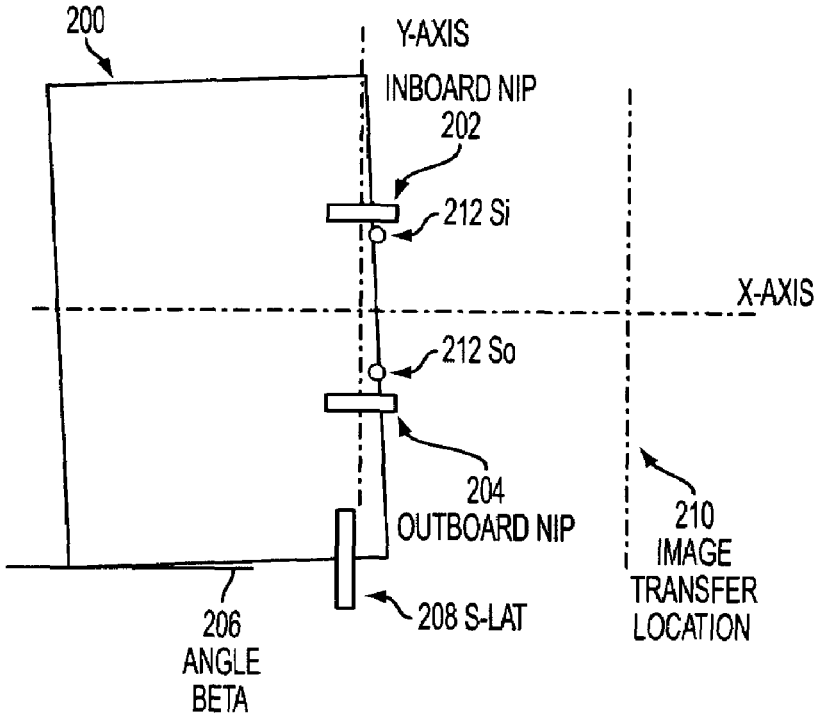
FIG. 2 is a schematic representation of a media registration system.

The media sheet registration system 108 is shown in greater detail in FIG. 2 and measures the position of the media sheet 200 when it arrives at the registration system 108. Lateral, process and skew are measured with a plurality of sensors 212. For example, sensors Si and So measure the time of arrival of the lead edge of the media sheet 200. The average time of arrival ((Si+So)/2) is used for process direction correction. For example, the difference in time of arrival (at Si and So) can be multiplied by the sheet velocity and divided by the sensor spacing as a measurement of the sheet angle Beta 206. The sensor S-lat 208 measures the lateral sheet position. This method measures sheet position before commencing the registration move. The angle and position of the sheet 200 are adjusted by unequal rotation of the inboard and outboard nip drives 202, 204 and the correction is performed so that the sheet can enter the image transfer location 210 without skew/misalignment.

Figure 3:
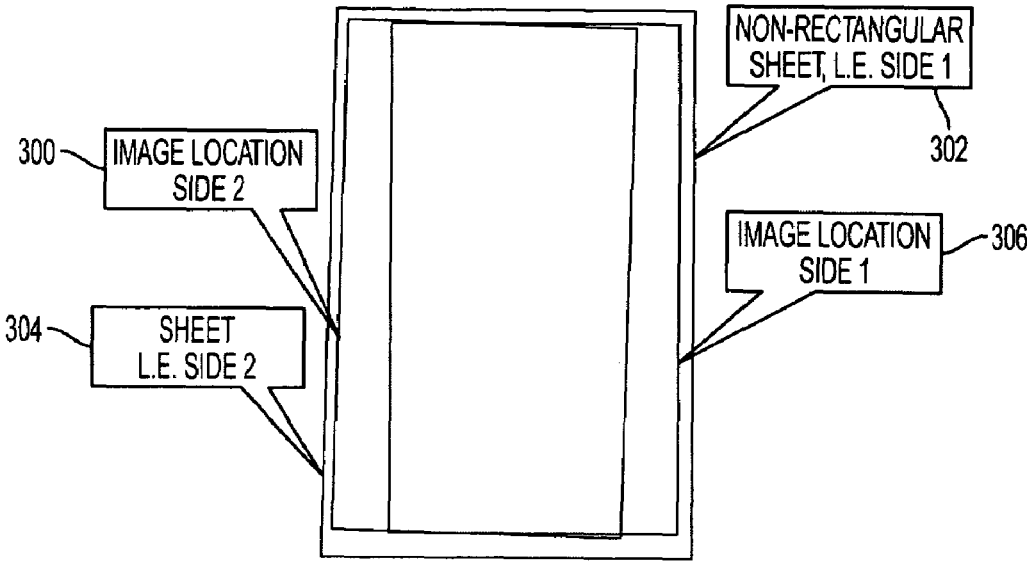
FIG. 3 is a schematic representation of two-sided registration errors.

As mentioned above, the inverter 104 transposes the lead edge and the trail edge of the media sheet 200. Hence, if the sheet is not a perfect rectangle, then side 1 to side 2 registration will have errors that are introduced by the media sheet not being a perfect rectangle. This is illustrated in the FIG. 3 where the image location for side 1 (306) was put down relative the right (LE) edge for the first pass. Note that the image for side 1 (306) is registered with the LE 302. After sheet inversion, the image location for side 2 (300) is printed. Note that the image for side 2 (300) is registered with the LE 304 for the second side. This shows that the non-parallelism of the LE and TE causes side 1 to side 2 skew errors. In addition, variation in sheet length causes process (x) direction side 1 to side 2 registration error.

Figure 4:
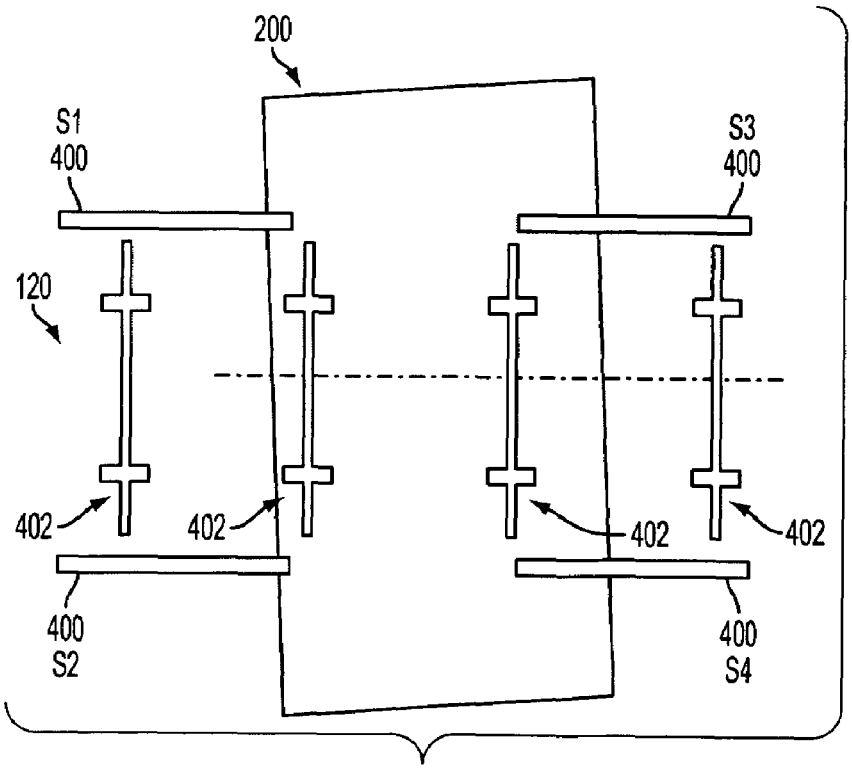
FIG. 4 is a schematic representation of media registration system and sensors.

In order to correct for these errors, the length/parallelism sensor 120 uses one or more sheet edge position sensors 400 to measure the sheet length and LE/TE parallelism, as show in FIG. 4. The sensors can comprise, for example, a contact image sensor model IA6008-FA30A manufactured by Rohm, or any other sensor that can detect a media sheet edge. For example, the sensors 400 can comprise any conventional sensors that are used in office automation communication devices (fax machines), electronic toys, etc. Such sensors are widely available and relatively inexpensive.

With embodiments herein, the sensors 400 (S1, S2, S3, S4) report the position of each relative edge that is adjacent to a given sensor to the registration controller 122. In one example, the signal processing circuitry for each sensor can output the number of pixels that are covered by the sheet to indicate the sheet edge position. The edge position on the sensor can then be calculated by the sensors 400 or the registration controller 120.

In one example, sheet length is obtained by the following combination: (S1+S2)/2−(S3+S4)/2+offset. The offset is the spacing between the sensors. Continuing with this example, the lead edge/trail edge parallelism can obtained from (S1−S2)/D12−(S3−S4)/D34, where D12 and D34 is the spacing between S1-S2 and S3-S4, respectively.

Any variation in sheet length and edge parallelism from a nominal value is input to the registration controller 122 which offsets registration targets of the drive nips 402 for improved side 1-side 2 registration. If very long sensors 400 (longer then the maximum media sheet length) are used, then only one inboard and one outboard sensor 400 can be used.

If only sheet length measurement is desired, then only two sensors 400 (or one very long sensor 400) can be used, and the sensor(s) 400 should be placed near the centerline of the media sheet path. Both the effect of cut edge tolerance and fuser sheet deformation can then be measured and corrected by the combination of the length/parallelism sensor 120 and the registration controller 122, and the correction factor sent by the registration controller 122 to the registration unit 108.

As mentioned above, the length/parallelism sensor 120 could be located at any location of the sheet path 100 that allows the sheet to be observed before or after the first side printing is completed, but before registration for the second side printing is performed. The location of the sensors 400 can be in a straight section of the media sheet path, or S1/S2 and S3/S4 can be separated by a (curved) baffle. This would give reduced, but yet satisfactory length/skew measurement accuracy.

Thus, some apparatus embodiments herein comprises, for example, an electrostatographic and/or xerographic machine that includes a media path 100 adapted to move a media sheet 200. Sensors 120 are positioned adjacent the media path 100. The media sheet 200 has a leading edge and a trailing edge and the sensors 120 are adapted to identify locations of the leading edge and the trailing edge of the media sheet 200. A marking device 102 is positioned adjacent the media path 100. The marking device 102 is adapted to print first items on a first side of the media sheet 200 and print second items on a second side of the media sheet 200.

A registration controller 122 is operatively connected to the registration unit 108 (that is part of the media path 100) and to the sensors 120. The registration controller 122 determines the length between the leading edge and the trailing edge of the media sheet 200 using output from the sensors 120, and determines the parallelism between the leading edge and the trailing edge of the media sheet 200 using output from the sensors 120. In one embodiment, the sensors are adapted to simultaneously (or approximately simultaneously) identify the locations of the leading edge and the trailing edge. Alternatively, the sensing of the leading and trailing edges can be performed at different times if the media sheet is stopped or if the velocity of the media sheet is known. The registration controller 122 calculates a registration correction factor based upon the length and the parallelism and corrects the alignment of the first items printed on the first side of the media sheet with the second items printed on the second side of the media sheet using the registration correction factor.

Figure 5:
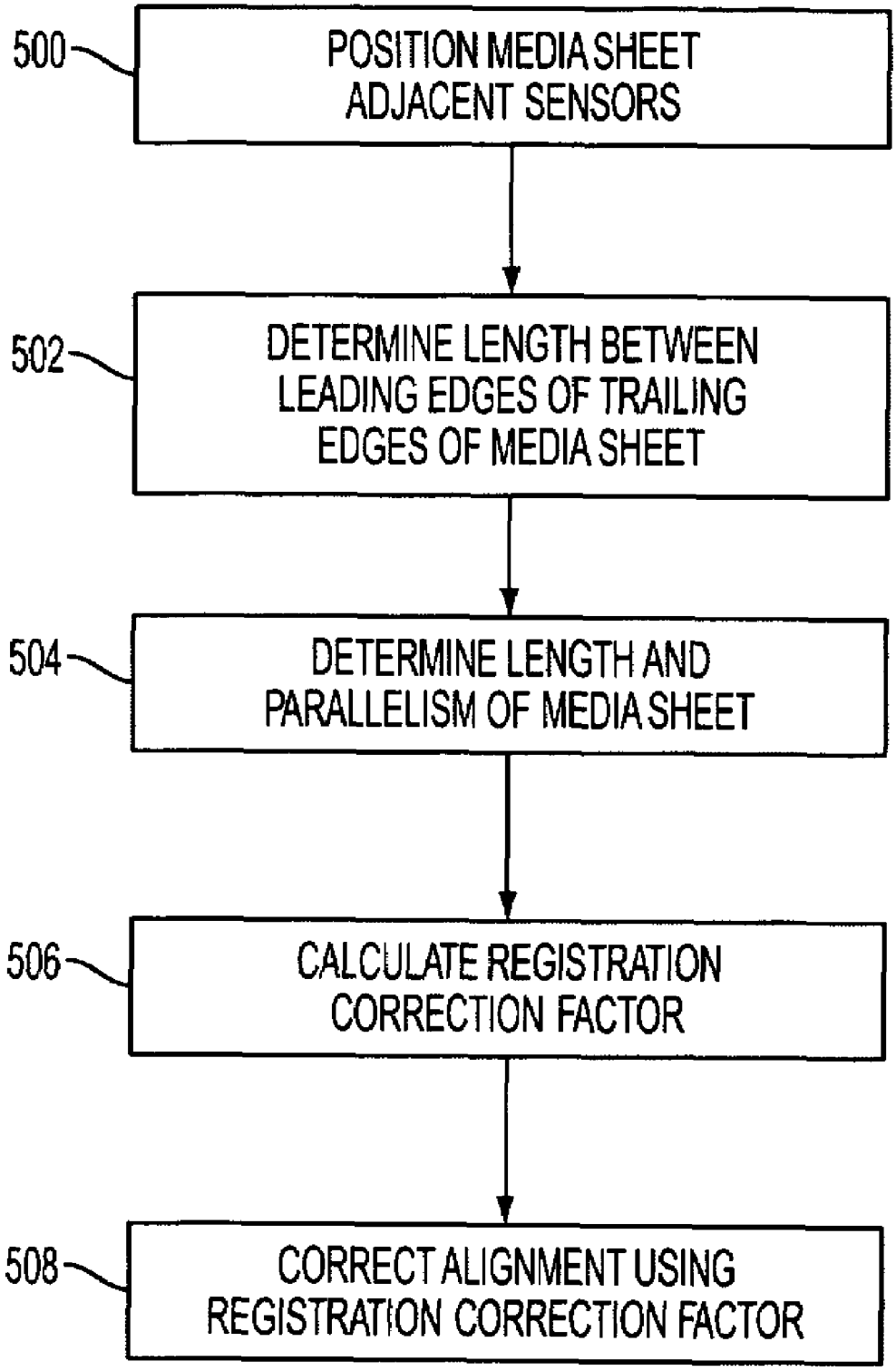
FIG. 5 is a flow diagram illustrating processing flow of embodiments herein.

As shown in flowchart form in FIG. 5, a method embodiment herein positions the media sheet adjacent sensors 500, determines the length between the leading edge and the trailing edge of the media sheet using output from the sensors 502, and determines the parallelism between the leading edge and the trailing edge of the media sheet using output from the sensors 504. Then, the method calculates a registration correction factor based upon the length and the parallelism 506. The correction factor indicates divergences from a predetermined length standard and a predetermined parallelism standard.

The method corrects the alignment of the first items printed on the first side of the media sheet with the second items printed on the second side of the media sheet using the registration correction factor 508. When correcting the alignment, the embodiments adjust the position of the media sheet with respect to a position of a marking device to compensate for the divergences. The positioning of the media sheet is performed after the first items are printed on the first side of the media sheet and before the second items are printed on the second side of the media sheet so that media size changes that occur during the fusing process of the first side printing can be included in the correction factor.

Thus, as shown above, two of the major error sources in side 1-side 2 registration are the sheet cut parallelism tolerances and media sheet size change during fusing of the first side printing. The lead edge of the sheet on side 1 becomes the trail edge on side 2 (after inversion). At the input of the registration system, the process and skew (angle) orientation can be established from measurement on the lead edge of side 1. After inversion, what was previously the trail edge, now becomes the lead edge. Hence, any sheet size/geometry tolerances will cause additional side 1-side 2 registration errors. The embodiments herein use sheet edge position sensors to measure the sheet edge lead edge and trail edge position in a multitude of locations at the same or approximately the same time. Calculations yield the values for the sheet length and/or sheet lead edge/trail edge parallelism. The sheet registration controller compensates for these errors by adding appropriated offsets to the registration targets to improve side 1-side 2 registration errors.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. Embodiments herein are applicable to monochrome printing apparatus, as well as those that print in color or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. A method comprising:

positioning a media sheet adjacent sensors, wherein said media sheet comprises a leading edge and a trailing edge and said sensors are adapted to identify locations of said leading edge and said trailing edge;

determining a length between said leading edge and said trailing edge of said media sheet using output from said sensors;

calculating a registration correction factor based upon said length; and correcting an alignment of first items printed on a first side of said media sheet with second items printed on a second side of said media sheet using said registration correction factor, wherein said sensors are adapted to simultaneously identify said locations of said leading edge and said trailing edge.

2. The method according to claim 1, wherein said correction factor indicates divergence from a predetermined length standard.

3. The method according to claim 2, wherein said correcting of said alignment adjusts a position of said media sheet with respect to a position of a marking device to compensate for said divergence.

4. The method according to claim 1, wherein said positioning of said media sheet is performed after said first items are printed on said first side of said media sheet.

5. A method comprising:

positioning a media sheet adjacent sensors, wherein said media sheet comprises a leading edge and a trailing edge and said sensors are adapted to identify locations of said leading edge and said trailing edge;

determining a length between said leading edge and said trailing edge of said media sheet using output from said sensors;

determining parallelism between said leading edge and said trailing edge of said media sheet using output from said sensors;

calculating a registration correction factor based upon said length and said parallelism; and correcting an alignment of first items printed on a first side of said media sheet with second items printed on a second side of said media sheet using said registration correction factor.

6. The method according to claim 5, wherein said correction factor indicates divergences from a predetermined length standard and a predetermined parallelism standard.

7. The method according to claim 6, wherein said correcting of said alignment adjusts a position of said media sheet with respect to a position of a marking device to compensate for said divergences.

8. The method according to claim 5, wherein said positioning of said media sheet is performed after said first items are printed on said first side of said media sheet.

9. The method according to claim 5, wherein said sensors are adapted to simultaneously identify said locations of said leading edge and said trailing edge.

10. An apparatus comprising:

a media path adapted to move a media sheet;

sensors positioned adjacent said media path, wherein said media sheet comprises a leading edge and a trailing edge and said sensors are adapted to identify locations of said leading edge and said trailing edge;

a marking device positioned adjacent said media path, wherein said marking device is adapted to print first items on a first side of said media sheet and print second items on a second side of said media sheet; and a registration controller operatively connected to said media path and to said sensors, wherein said registration controller is adapted to:

determine a length between said leading edge and said trailing edge of said media sheet using output from said sensors;

calculate a registration correction factor based upon said length; and correct an alignment of said first items printed on said first side of said media sheet with said second items printed on said second side of said media sheet using said registration correction factor, wherein said sensors are adapted to simultaneously identify said locations of said leading edge and said trailing edge.

11. The apparatus according to claim 10, wherein said correction factor indicates divergences from a predetermined length standard.

12. The apparatus according to claim 11, wherein when said registration controller corrects said alignment, said registration controller adjusts a position of said media sheet on said media path with respect to a position of said marking device to compensate for said divergences.

13. The apparatus according to claim 10, wherein said sensors are adapted to identify said locations of said leading edge and said trailing edge after said first items are printed on said first side of said media sheet.

14. An apparatus comprising:

a media path adapted to move a media sheet;

sensors positioned adjacent said media path, wherein said media sheet comprises a leading edge and a trailing edge and said sensors are adapted to identify locations of said leading edge and said trailing edge;

a marking device positioned adjacent said media path, wherein said marking device is adapted to print first items on a first side of said media sheet and print second items on a second side of said media sheet; and a registration controller operatively connected to said media path and to said sensors, wherein said registration controller is adapted to:

determine a length between said leading edge and said trailing edge of said media sheet using output from said sensors;

determine parallelism between said leading edge and said trailing edge of said media sheet using output from said sensors;

calculate a registration correction factor based upon said length and said parallelism; and correct an alignment of said first items printed on said first side of said media sheet with said second items printed on said second side of said media sheet using said registration correction factor.

15. The apparatus according to claim 14, wherein said correction factor indicates divergences from a predetermined length standard and a predetermined parallelism standard.

16. The apparatus according to claim 14, wherein when said registration controller corrects said alignment, said registration controller adjusts a position of said media sheet on said media path with respect to a position of said marking device to compensate for said divergences.

17. The apparatus according to claim 14, wherein said sensors are adapted to identify said locations of said leading edge and said trailing edge after said first items are printed on said first side of said media sheet.

18. The apparatus according to claim 14, wherein said apparatus comprises at least one of an electrostatographic and a xerographic machine and process.

* * * * *